US007682035B2

(12) United States Patent
Wuensch et al.

(10) Patent No.: US 7,682,035 B2
(45) Date of Patent: Mar. 23, 2010

(54) HOUSING DEVICE FOR HAND-HELD POWER TOOL

(75) Inventors: Steffen Wuensch, Holzgerlingen (DE); Wolfgang Hirschburger, Thurston (GB); Manfred Lutz, Filderstadt (DE); Sim Teik Yeoh, Butterworth (MY)

(73) Assignee: Robert Bosch GmbH, Stuttgart (DE)

( * ) Notice: Subject to any disclaimer, the term of this patent is extended or adjusted under 35 U.S.C. 154(b) by 377 days.

(21) Appl. No.: 11/453,666

(22) Filed: Jun. 16, 2006

(65) Prior Publication Data

US 2007/0044983 A1 Mar. 1, 2007

(30) Foreign Application Priority Data

Sep. 1, 2005 (DE) ..... 10 2005 041 489

(51) Int. Cl.
*B25B 23/18* (2006.01)

(52) U.S. Cl. ..... 362/119; 362/109

(58) Field of Classification Search ..... 362/119, 362/109, 23, 800; 340/815.45, 815.5, 815.57, 340/815.89

See application file for complete search history.

(56) References Cited

U.S. PATENT DOCUMENTS

| | | | | |
|---|---|---|---|---|
| 4,876,632 | A * | 10/1989 | Osterhout et al. | 362/183 |
| 5,130,658 | A * | 7/1992 | Bohmer | 324/435 |
| 5,293,156 | A * | 3/1994 | Shoji et al. | 340/636.1 |
| 5,473,519 | A * | 12/1995 | McCallops et al. | 362/120 |
| 5,536,543 | A * | 7/1996 | Papandreou | 428/35.7 |
| 5,610,511 | A * | 3/1997 | Parker | 324/106 |
| 6,184,794 | B1 * | 2/2001 | Tucholski | 340/636.14 |
| 6,494,827 | B1 * | 12/2002 | Matsumoto et al. | 600/118 |
| 6,616,296 | B1 * | 9/2003 | Roux et al. | 362/184 |
| 7,029,142 | B2 * | 4/2006 | Chen et al. | 362/119 |
| 7,182,148 | B1 * | 2/2007 | Szieff | 173/20 |
| 2002/0105804 | A1 * | 8/2002 | Li | 362/253 |
| 2003/0043016 | A1 * | 3/2003 | Kady et al. | 340/5.1 |
| 2005/0025599 | A1 | 2/2005 | Kopras et al. | |
| 2005/0083676 | A1 * | 4/2005 | VanderSchuit | 362/84 |
| 2005/0135084 | A1 * | 6/2005 | Chen et al. | 362/109 |
| 2005/0152131 | A1 * | 7/2005 | Shirane | 362/119 |
| 2006/0120090 | A1 * | 6/2006 | Wikle et al. | 362/396 |
| 2006/0243105 | A1 | 11/2006 | Delfini et al. | |
| 2008/0111703 | A1 * | 5/2008 | Hsieh | 340/665 |

FOREIGN PATENT DOCUMENTS

| | | |
|---|---|---|
| DE | 34 33 552 | 3/1986 |
| FR | 2 557 352 | 6/1985 |
| GB | 2 054 269 | 2/1981 |
| GB | 2 146 317 | 4/1985 |
| WO | 97/38842 | 10/1997 |
| WO | 03/041914 | 5/2003 |
| WO | 2005/097431 | 10/2005 |

* cited by examiner

*Primary Examiner*—Jacob Y Choi
(74) *Attorney, Agent, or Firm*—Michael J. Striker

(57) ABSTRACT

A housing device for a hand-held power tool has at least one see-through region composed of a transparent plastic, and having an interior side configured as a carrier for an element selected from the group consisting of an information element, a signal element, and both; and also a hand-held power tool is provided with such a housing device.

21 Claims, 5 Drawing Sheets

HOUSING DEVICE FOR HAND-HELD POWER TOOL

BACKGROUND OF THE INVENTION

The present invention relates in particular to a power tool with a housing device.

It has already been provided to equip a housing device for a hand-held power tool with a liquid crystal display that includes a see-through region made of plastic that covers the actual display and protects it from damage.

SUMMARY OF THE INVENTION

The present invention relates in particular to a housing device for a hand-held power tool with at least one transparent region made of a transparent plastic in particular.

It is provided that an interior side of the see-through region is a carrier for an information and/or signal element. Advantageously, a robust information and/or signal element protected by the see-through region is obtained as a result, the information and/or signal element forming a single assembly with the see-through region. A robust design of the information and/or signal element itself—which is needed in conjunction with hand-held power tools due to the high stresses involved—can be advantageously eliminated, thereby reducing production costs.

In addition to housings of hand-held power tools, and electric hand-held power tools in particular, examples of housing devices for hand-held power tools include accessories for hand-held power tools, e.g., charging devices or their housings. In this context, the "interior side" refers to every side of a component that is inaccessible to an operator during normal operation.

In a refinement of the present invention, it is provided that the housing device for the hand-held power tool includes at least one illuminating element for illuminating the interior side of the see-through region. As a result, it is possible for the information and/or signal element to be easily seen by an operator even when lighting conditions are poor.

If the illuminating element is provided so it can be activated depending on an operating mode of a hand-held power tool that includes a see-through region, it is possible for the operating mode to be easily determined by an operator at any time.

An overloading of the hand-held power tool can be prevented when the illuminating element is provided so it can be activated depending on a speed of a hand-held power tool that includes the see-through region. In this context, the term "provided" should be understood to also mean "designed" and "equipped". It is also feasible for the illuminating element to be activatable, e.g., as a function of a load or power uptake and/or as a function of a temperature detected by a temperature sensor. In a further embodiment of the present invention, the illuminating element is connected with an electronic device that detects a state of charge of a rechargeable battery or battery pack associated with the housing device of the hand-held power tool.

An advantageously robust and simple assembly and, therefore, easier assembly, can be attained if the illuminating element is cast with the see-through region.

A dangerous temperature development can be prevented when the illuminating element is designed as a light-emitting diode.

Extensive light-scattering and, therefore, homogeneous illumination can be generated by a light-emitting diode in particular when it has a flat light exit surface.

Potential cost savings for assembly and a simple design of the housing device for the hand-held power tool can be attained when the light-emitting diode is designed as a surface-mountable light-emitting diode. In this context, a surface-mountable light-emitting diode refers to light-emitting diodes that can be soldered directly to a printed circuit board without conductor tips. A component of this type is often referred to as a "Surface Mounted Device" (SMD).

An information and/or signal element with information content that is seen particularly easily can be attained when the interior side of the see-through region includes, in at least one subregion, a mask that is impermeable to at least one part of a visible light spectrum. This is attainable in a particularly cost-effective manner when the mask is printed on or bonded to the interior side of the see-through region.

The manufacturer of the hand-held power tool can be determined reliably and quickly, e.g., to order replacement parts, when the information and/or signal element is a product label. Furthermore, this would allow plastic components to be recycled particularly easily, and especially when the product label is machine-readable. Embodiments of the present invention are also feasible with which the labeling element is designed to be machine-readable, e.g., as a barcode. In addition, the labeling element can include recycling information that can apply to the material of which the housing part of the hand-held power tool is composed.

A splintering-off of the see-through region and, therefore, a risk of damage or injury caused by the see-through region can be at least reduced when the see-through region is elastic in design.

An advantageous combination of a switching function and an information and/or signal function can be attained when the housing device for the hand-held power tool includes a switching element located underneath the see-through region provided to switch over an operating mode of a hand-held power tool that includes the see-through region. By pressing on a symbol on the see-through region, an operator can then call up a switching function associated with this symbol, by way of which particularly comfortable operator guidance is attained.

If the hand-held power tool includes a control unit for actuating the illumination unit as a function of an operating mode of a hand-held power tool that includes the see-through region, the operating state can be visualized in an impressive manner via a triggering of the illumination unit.

In addition to the simple on and off state of the illuminating unit, additional states can be attained and, therefore, so can a greater content of information that is transmittable via the illuminating unit when the control unit is provided for turning the illuminating unit on and off periodically in at least one operating mode. The resultant flashing of the illuminating unit can direct the operator's attention to the illuminating unit and, e.g., visualize a state in which the hand-held power tool carries out a process automatically.

A separate information and/or signal element can be eliminated when the see-through region is designed as a lettering motif.

Further advantages result from the description of the drawing, below. Exemplary embodiments of the present invention are shown in the drawing. The drawing, the description and the claims contain numerous features in combination. One skilled in the art will also advantageously consider the features individually and combine them to form further reasonable combinations.

DESCRIPTION OF THE PREFERRED EMBODIMENTS

Figure 1:
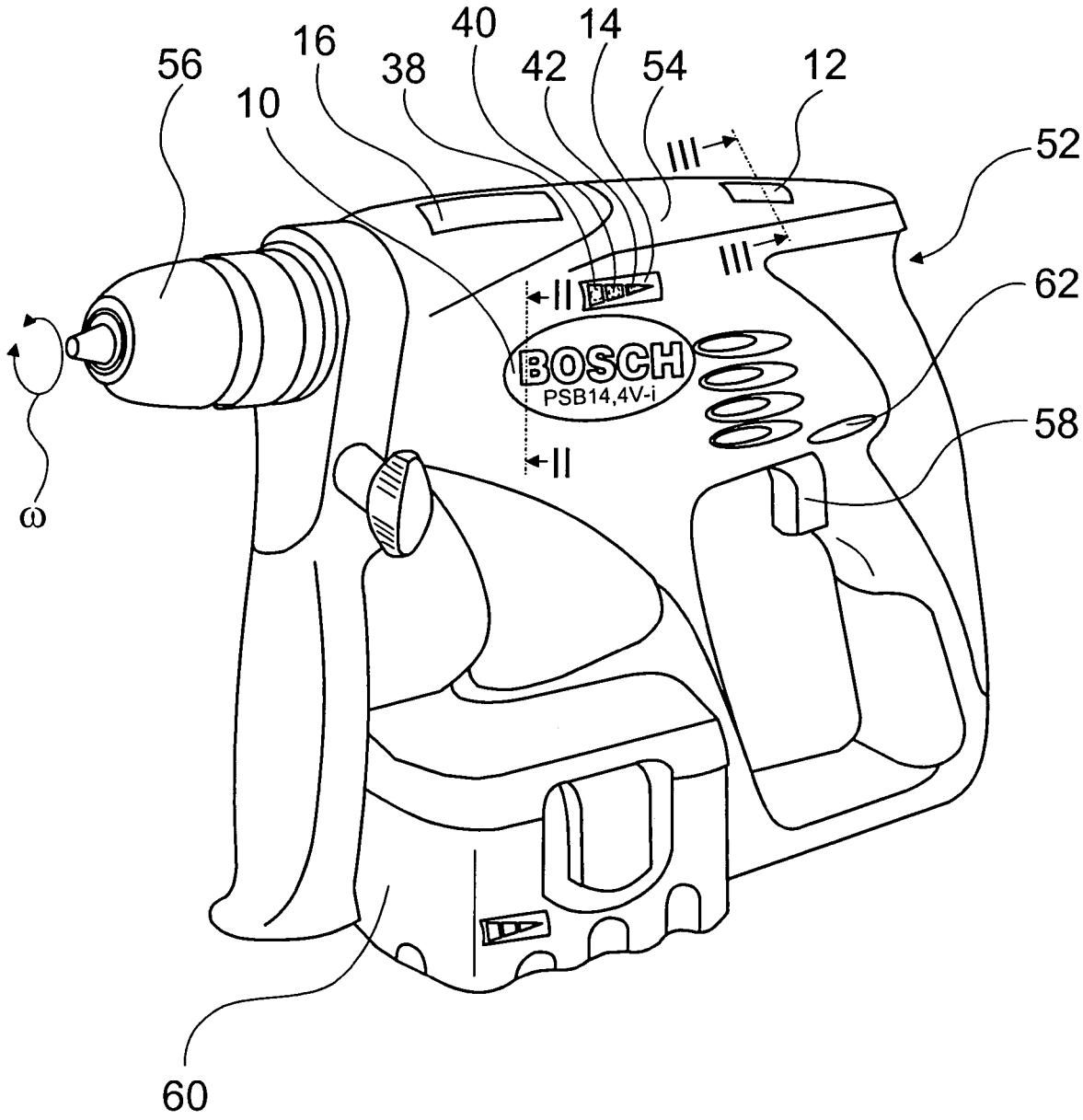
FIG. 1 shows a hand-held power tool with a housing that includes four see-through regions, in a view at an angle from above, in accordance with the present invention.

FIG. 1 shows a hand-held power tool 52 designed as a cordless impact drill with a screwdriver function, with a plastic housing 54 in which a not-shown electric motor is located. The electric motor drives a tool chuck 56 with a speed ω that can be adjusted using a control button 58, speed ω being detected by a not-shown speed sensor. Tool chuck 56 is suitable for accommodating drill bits or screwdriver bits, among other things.

A replaceable rechargeable battery pack 60 is detachably connected in a lower region of housing 54. A right-left changeover switch 62 that is designed as a sliding element is captively held in the region of control button 58, via which the operator can adjust a direction of rotation of the electric motor.

Four see-through regions 10-16 made of a transparent plastic are fastened to housing 54, each of which is a carrier for an information and/or signal element 26-32.

Figure 2:
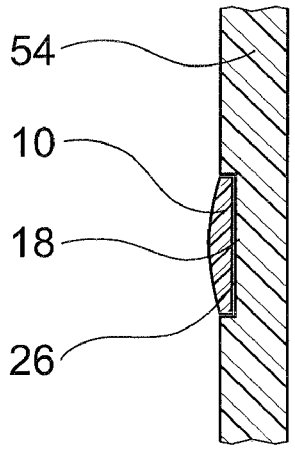
FIG. 2 shows a first see-through region of the hand-held power tool in FIG. 1 in a sectional view, in accordance with the present invention.

First see-through region 10 is oval and is made of a transparent plastic and, in fact, of polyacrylate, and is bonded in a corresponding oval recess in housing 54. In an alternative embodiment of the present invention, see-through region 10 is injected into the recess in housing 54. An interior side 18 (FIG. 2) of see-through region 10 includes a color layer that is an information and signal element 26. To this end, the color layer includes a corporate logo and a product label that is visible from the outside through see-through region 10. Information and signal element 26 is protected from wear by the body of see-through region 10. Interior side 18 is therefore a carrier for information and signal element 26.

Figure 3:
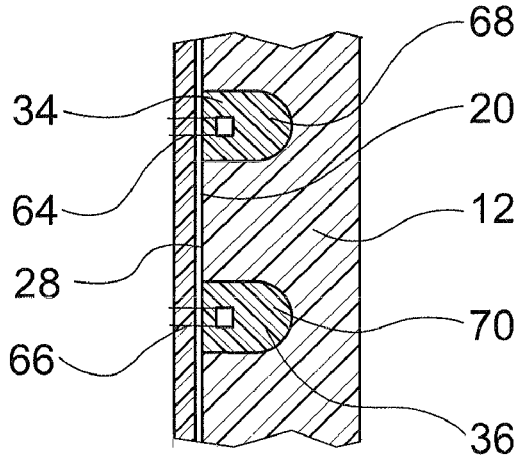
FIG. 3 shows a second see-through region of the hand-held power tool in FIG. 1 in a sectional view, in accordance with the present invention.

Second see-through region 12 is rectangular and includes an information element 28 applied to its interior side 20 and designed as a color layer, and two illuminating elements 34, 36 designed as light-emitting diodes that are cast—together with their conductor tips 64, 66 and their plastic-resin lenses 68, 70—with a transparent material of see-through region 12 in an injection-moulding procedure, and define the signal elements (FIG. 3).

Figure 4:
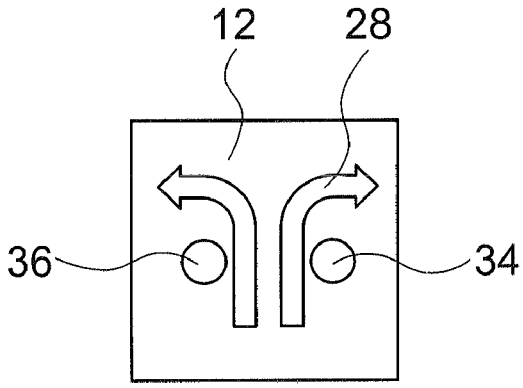
FIG. 4 shows the see-through region in FIG. 3, in a top view, in accordance with the present invention.

Illuminating elements 34, 36 are connected in the circuit such that illuminating element 34 is activated when the right-left changeover switch 62 is switched to right-hand rotation, and such that illuminating element 36 is activated when right-left changeover switch 62 is switched to left-hand rotation. As a result, illuminating elements 34, 36 are activated as a function of an operating mode of hand-held power tool 52. Information element 28 visualizes the direction of rotation of the electric motor using arrows, each of which is associated with one of the illuminating elements 34, 36 (FIG. 4).

Third see-through region 14 (FIG. 5) is imprinted on the interior side 22 with an information element 30 designed as a completely light-impermeable mask, information element 30 including three polygonal recesses 116-120 that, taken together, form an acute-angled, isosceles triangle. An illuminating element 38-42 designed as a light-emitting diode is located underneath each one of the recesses 116-120.

Illuminating element 38 underneath recess 116 is activated when speed ω exceeds a lower speed threshold. Illuminating element 40 underneath middle recess 118 is activated when speed ω exceeds a middle speed threshold. Furthermore, illuminating element 42 underneath recess 120 is activated when speed ω exceeds an upper speed threshold. Illuminating elements 38-42 are therefore activated as a function of speed to of hand-held power tool 52. To this end, control unit 18 of hand-held power tool detects speed ω via the speed sensor.

In an alternative embodiment of the present invention, push-buttons that can be activated by the operator via pushing are located underneath recesses 116-118. During operation, hand-held power tool 52 then regulates speed ω to a value associated with the particular push-button.

Figure 6:
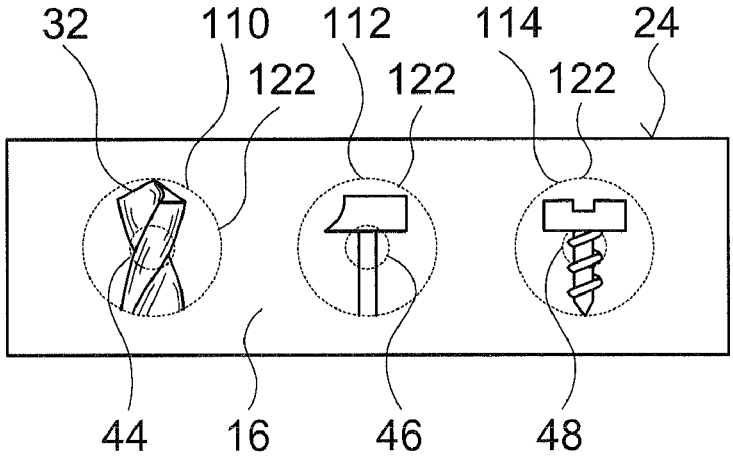
FIG. 6 shows a fourth see-through region of the hand-held power tool in FIG. 1 in a top view, in accordance with the present invention.

Fourth see-through region 16 (FIG. 6) is made of a flexible yet stable foil and includes a color layer on its interior side 24, the color layer depicting a drill, a hammer and a screwdriver, and therefore serves as an information element 32.

Figure 5:
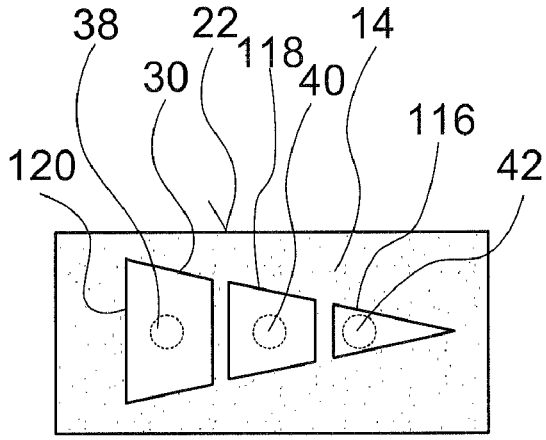
FIG. 5 shows a third see-through region of the hand-held power tool in FIG. 1 in a sectional view, in accordance with the present invention.

The switching elements 110-114 designed as contact switches and each one being assigned to one of the printed symbols are located underneath see-through region 16, the position of the printed symbols being indicated using dotted lines in FIG. 5. Switching elements 110-114 are designed as flat foil switches 122, they are bonded with see-through region 16 and each includes a central recess, underneath each of which an illuminating element 44-48 is located.

When an operator of hand-held power tool 52 presses first switching element 110, hand-held power tool 52 therefore switches to a drilling mode and activates illumination element 44. When an operator of hand-held power tool 52 presses second switching element 112, hand-held power tool 52 switches to an impact drilling mode and activates illuminating element 46, in order to visualize the operating mode that was selected. Finally, when an operator of hand-held power tool 52 presses third switching element 114, hand-held power tool 52 switches to a screwdriver mode and activates illuminating element 48.

FIGS. 7 through 16 show further exemplary embodiments of the present invention. The description will mainly address the differences from the exemplary embodiments shown in FIGS. 1 through 6. With regard for the features that are identical, reference is made to the description of the exemplary embodiments shown in FIGS. 1 and 6.

Figure 7:
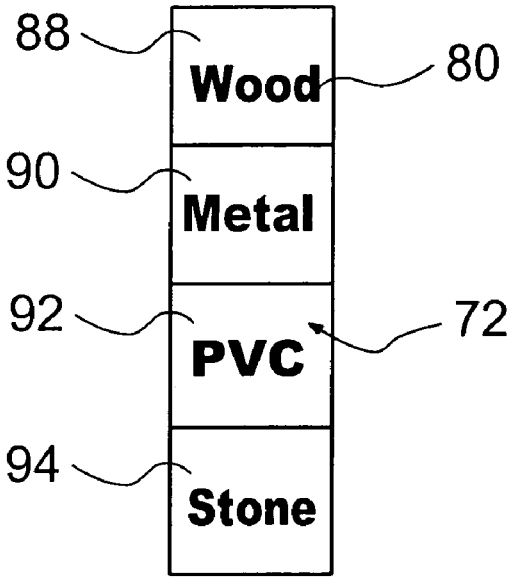
FIG. 7 shows a see-through region of an alternative hand-held power tool, in a top view, in accordance with the present invention.

FIG. 7 shows a see-through region 72 that is capable of being integrated in an alternative hand-held power tool that can be operated in at least four different operating programs. Each of the operating programs is optimized for a certain material to be worked. See-through region 72 is made of a flexible, transparent, foil-like material and is imprinted on the interior side with a color layer that is an information and signal element 80 and is subdivided by see-through region 72 into four square regions 88-94.

A push button is located underneath first region 88, via which an operating program optimized for wood can be started. Information and signal element 80 displays the word "Wood" in region 88. A push button is located underneath second region 90, via which an operating program optimized for metal can be started. Information and signal element 80 displays the word "Metal" in region 90. A push button is located underneath third region 92, via which an operating program optimized for a low speed ω for plastic can be started. Information and signal element 80 displays the acronym "PVC" in region 92. A push button is located underneath first region 94, via which an operating program optimized for wood can be started. Information and signal element 80 displays the word "Stone" in region 94.

Figure 8:
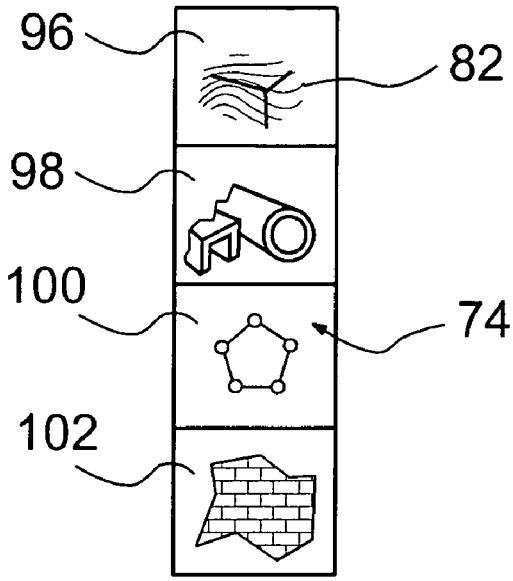
FIG. 8 shows a see-through region of a further alternative hand-held power tool, in a top view, in accordance with the present invention.

FIG. 8 shows a see-through region 74 that is entirely similar to see-through region 72 shown in FIG. 7 and has an information and/or signal element 82 and four regions 96-102, in which pictograms for the particular materials are shown, instead of the terms "Wood", "Metal", "PVC" and "Stone".

Figure 9:
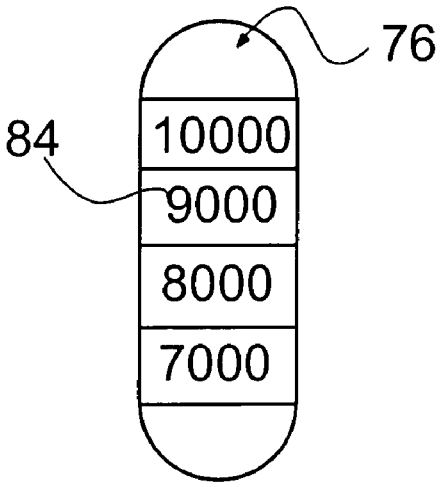
FIG. 9 shows a see-through region of a further alternative hand-held power tool, in a top view, in accordance with the present invention.

FIG. 9 shows a further alternative see-through region 76 with an information and/or signal element 84 that is provided for visualizing a speed ω of a hand-held power tool, similar to see-through region 14 described above. Information and/or signal element 84 imprinted on an interior side shows four speeds, depicted numerically, underneath each of which a light-emitting diode (not shown here explicitly) is located, the light-emitting diode being activated when speed ω sensed by a speed sensor exceeds the particular, numerically depicted speed.

Figure 10:
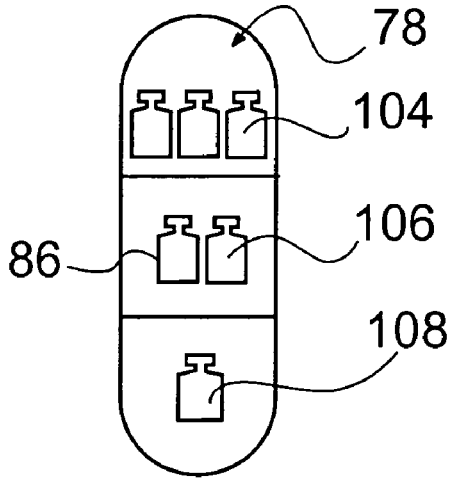
FIG. 10 shows a see-through region of a further alternative hand-held power tool, in a top view, in accordance with the present invention.

FIG. 10 shows a further alternative see-through region 78 that is capable of being integrated in a housing part of a hand-held power tool that includes a torque sensor. The torque sensor can detect the torque produced by the hand-held power tool directly, or it can determine the torque indirectly via a current consumption of the hand-held power tool. See-through region 78 is subdivided into three ranges 104-108 in which an information and signal element 86 bonded to the interior side displays a load on the hand-held power tool and, in fact, via a number of pictograms of weights. A colored light-emitting diode (not shown here explicitly) is located underneath each of the ranges 104-108 and is activated by a control unit 180 when a torque detected by the torque sensor exceeds a threshold value assigned to particular range 104-108.

The light-emitting diode located under range 108 is green and communicates to the operator that the hand-held power tool is being subjected to a minimal, mild load. The light-emitting diode located under range 106 is yellow or orange and communicates to the operator that the hand-held power tool is being subjected to a load that is tolerable for long-term operation. Finally, the light-emitting diode located under range 104 is red and communicates to the operator that the hand-held power tool is being subjected to an overload that can be tolerated only briefly. If the hand-held power tool is operated for a long period of time in the overload range, damage may result.

Figure 11:
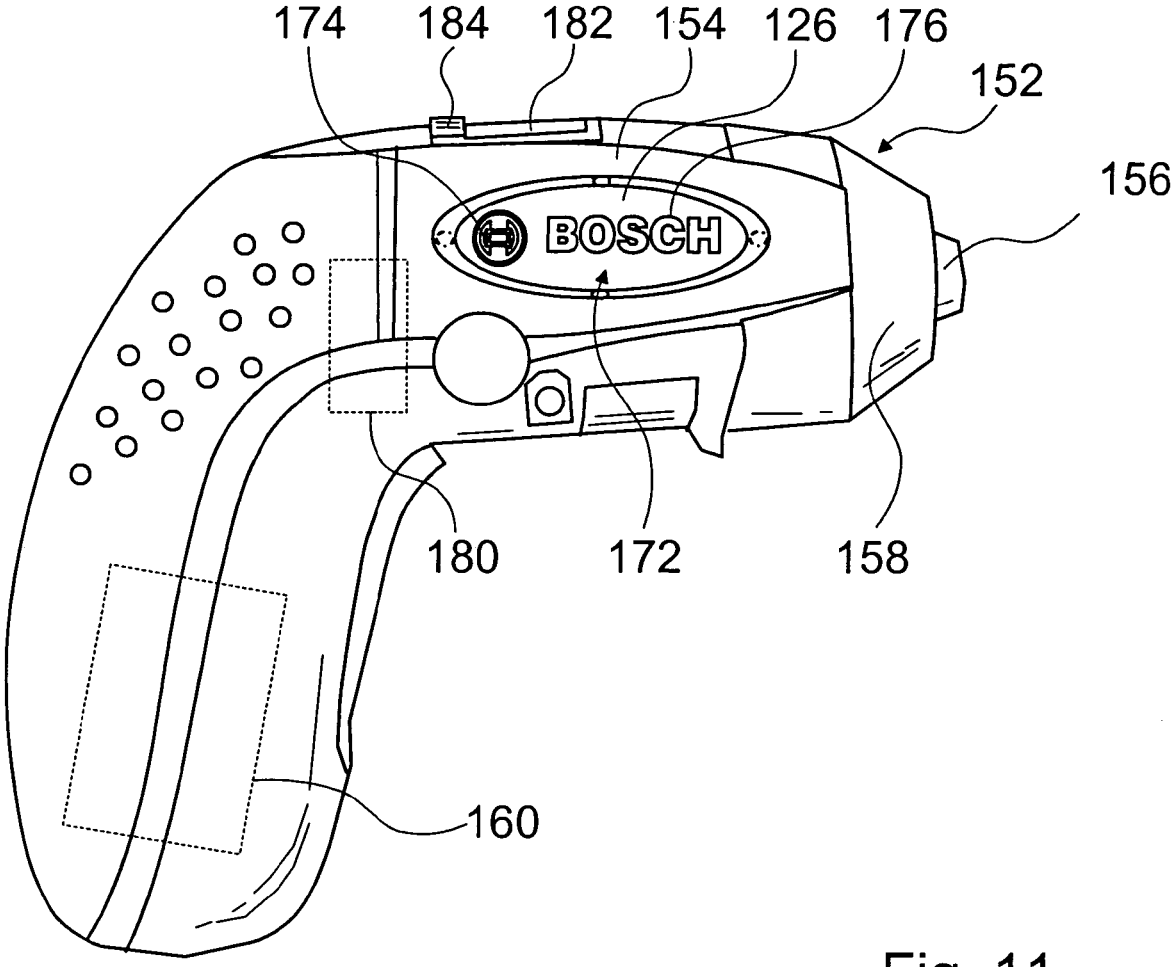
FIG. 11 shows a further alternative hand-held power tool with a see-through region on which a manufacturer's logo is provided, in accordance with the present invention.

FIG. 11 shows an alternative hand-held power tool 152 designed as a cordless screwdriver, with a plastic housing 154 in which a not-shown electric motor is located. The electric motor drives a tool chuck 156 with a torque that can be adjusted using an operating element 158. Tool chuck 156 is suitable for accommodating drill bits or screwdriver bits, among other things.

A display 182 with an input switch 184 is located on a top side of housing 154, via which the operator can enter an operating mode and an operating parameter of hand-held power tool 152.

A see-through region 172 made of transparent plastic is located on the side of housing 154, on the interior side (not shown here explicitly) of which an information and/or signal element 126 has been imprinted, information and/or signal element 126 including a manufacturer's logo 174 and a lettering motif 176 of the manufacturer of hand-held power tool 152 that can be seen from the outside. See-through region 172 shown enlarged in FIG. 12 is shown oval in shape and has a restrictor 178 on its exterior, behind which four illuminating elements 134-140 designed as superbright, white, light-emitting diodes are hidden and that illuminate colored manufacturer's logo 174 and lettering motif 176.

Hand-held power tool 152 also includes a control unit 180 for controlling the four illuminating elements 134-140 depending on an operating mode of hand-held power tool 152. Control unit 180 can cause illuminating elements 134-140 to remain on or off, or it can turn them on and off periodically in a flashing mode, i.e., it can make them flash. When illuminating elements 134-140 remain turned on, this signals to the user that hand-held power tool 152 is basically ready to operate. When they remain turned off, this signals that there is no current supply.

If control unit 180 expects to receive input from the operator via input switch 184, control unit 180 actuates illuminating elements 134-140 in the periodic flashing mode in which illuminating elements 134-140 are turned on and off at intervals of 3 $sec^{-1}$. An input of this type can involve making a selection between a right-rotation mode and a left-rotation mode of hand-held power tool 152. When the operator has made an input, control unit 180 switches to the mode with constant illumination. In general, the flashing mode is also permanently switched on when hand-held power tool 152 carries out a process that cannot be influenced from the outside. An example of a process of this type is when a rechargeable battery pack 160 of hand-held power tool 152 is being recharged.

Figure 12:
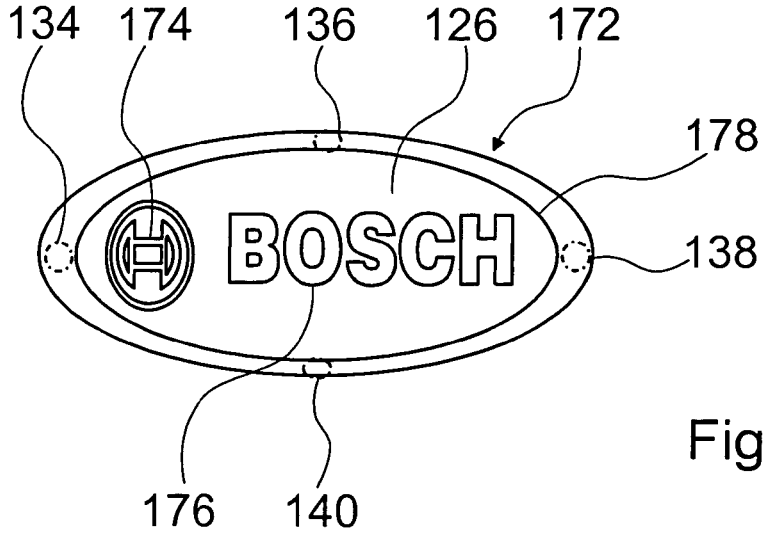
FIG. 12 shows the manufacturer's logo in FIG. 11, in accordance with the present invention.
Figure 13:
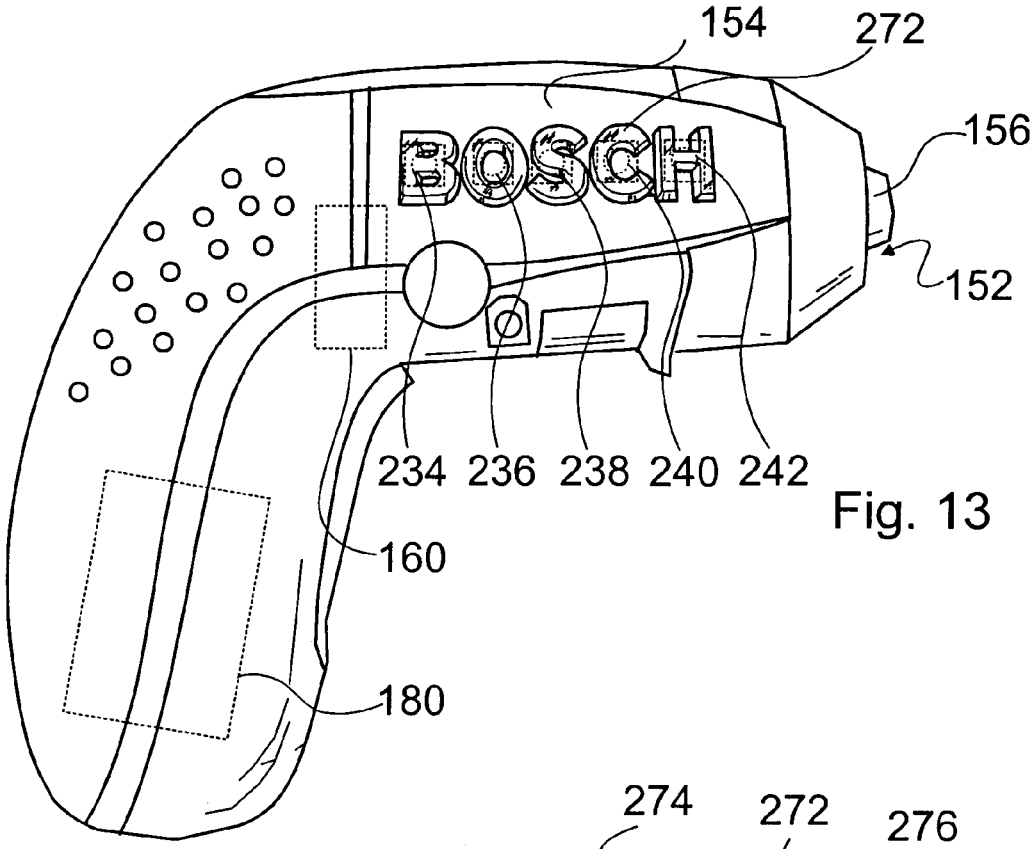
FIG. 13 shows a further alternative hand-held power tool with a see-through region that is designed as a lettering motif, in accordance with the present invention.
Figure 14:
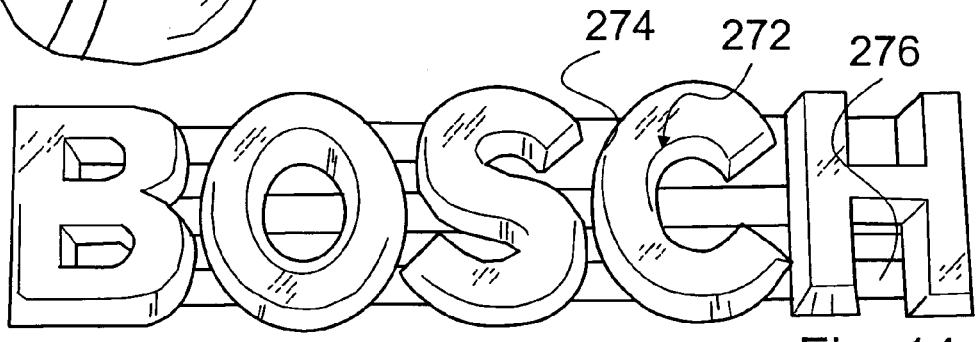
FIG. 14 shows the see-through region in FIG. 13, in accordance with the present invention.

A hand-held power tool 152 shown in FIG. 13 and designed as a cordless screwdriver is largely similar in design to hand-held power tool 152 shown in FIGS. 11 and 12. The description below is therefore limited to the differences from hand-held power tool 152 shown is in FIGS. 11 and 12. Similar features are labeled with the same reference numerals.

A see-through region 272 made of transparent plastic is located on the side of housing 154, has the shape of a lettering motif and therefore serves as a signal and display element itself. Behind each of the five letters in the lettering motif, an illuminating element 234-240 designed as a white, light-emitting diode is located on a printed circuit board imprinted with conductor tracks. The individual letters of see-through region 272 are interconnected via segments 274, 276 (FIG. 14) and, in an installed state, pass through housing 154 from an interior side, so that segments 274, 276 are located in an interior of housing 154.

Figure 15:
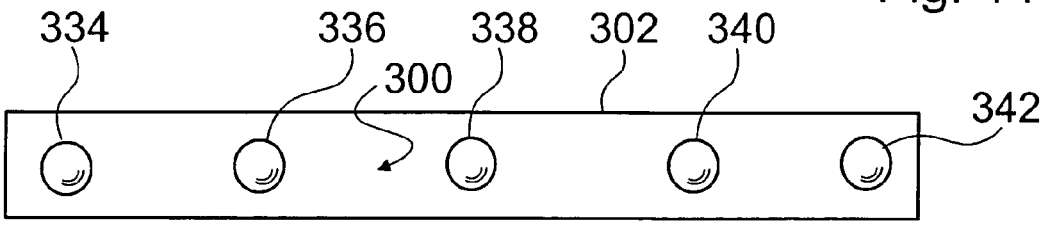
FIG. 15 shows an illuminating unit of a further alternative housing device of a hand-held power tool, in accordance with the present invention.

FIG. 15 shows an illuminating device 300 for illuminating a see-through region 272 designed as a lettering motif and of the type depicted in FIGS. 13 and 15. Illuminating device 300 includes five illuminating elements 334-342 grouped together on the same printed circuit board 302, as an assembly.

Figure 16:
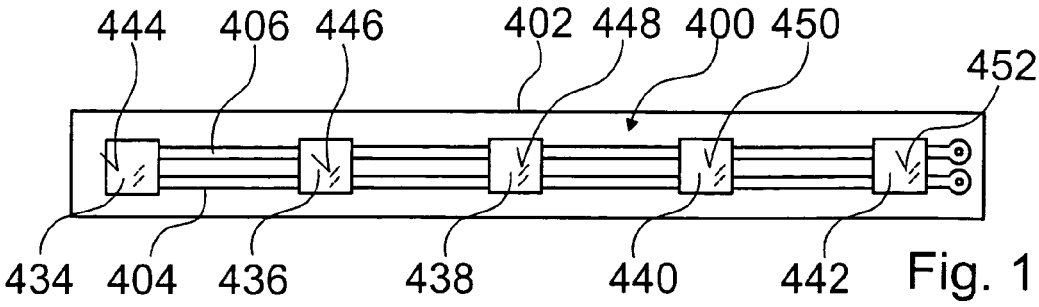
FIG. 16 shows a further illuminating unit of a further alternative housing device of a hand-held power tool, in accordance with the present invention.

FIG. 16 shows a further, alternative illuminating device 400 for illuminating a see-through region 272 designed as a lettering motif and of the type depicted in FIGS. 13 and 15. Illuminating device 400 includes five illuminating elements 434-442 grouped together on the same printed circuit board 402, as an assembly, illuminating elements 434-442 being designed as surface-mountable SMD light-emitting diodes.

Printed circuit board 402 is imprinted on a front side with conductor tracks 404, 406, and illuminating elements 434-442 are soldered directly with conductor tracks 404, 406 without penetrating printed circuit board 402. Each of the illuminating elements 434-442 designed as light-emitting diodes includes a light exit surface 444-452, through which the light from illuminating elements 434-442 is scattered diffusely, and by way of which a flat design is attainable.

It will be understood that each of the elements described above, or two or more together, may also find a useful application in other types of constructions differing from the types described above.

While the invention has been illustrated and described as embodied in a housing device for hand-held power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A housing device for a hand-held power tool comprising a housing which is provided to receive an electric motor of the power tool;

at least one see-through region composed of a transparent plastic, wherein said at least one see-through region is distinct from said housing and fastened to said housing and forms an exterior side face oriented to an exterior of the housing device and an interior side face opposite to the exterior side face and oriented to an interior of the housing device; and an element selected from the group consisting of an information element, a signal element, and both, which is arranged on the interior side face of the see-through region, wherein said element selected from the group consisting of an information element, a signal element, and both, is provided with at least a first and a second symbol and a first and second illuminating element which are distinct from said element selected from the group consisting of an information element, a signal element and both, and which are covered by said see-through region and said element selected from the group consisting of an information element, a signal element, and both, and wherein the first symbol is illuminated by the first illuminating element in a first operating mode of the hand-held power tool and the second symbol is illuminated by the second illuminating element in a second operating mode of the hand-held power tool.

2. A housing device for a hand-held power tool as defined in claim 1; and further comprising at least one illuminating element for illuminating said interior side face of said see-through region.

3. A housing device for a hand-held power tool as defined in claim 2, wherein said illuminating element is configured so as to be activated depending on an operating mode of a hand-held power tool that includes said see-through region.

4. A housing device for a hand-held power tool as defined in claim 2, wherein said illuminating element is configured so as to be activated depending on a speed of a hand-held power tool that includes said see-through region.

5. A housing device for a hand-held power tool as defined in claim 2, wherein said illuminating element is distinct from said see-through region and is configured as an element which is cast with said see-through region.

6. A housing device for a hand-held power tool as defined in claim 2, wherein said illuminating element is configured as a light-emitting diode.

7. A housing device for a hand-held power tool as defined in claim 2, wherein said illuminating unit includes a light exit surface.

8. A housing device for a hand-held power tool as defined in claim 2, wherein said illuminating element is configured as a surface-mountable light-emitting diode.

9. A housing device for a hand-held power tool as defined in claim 2; and further comprising a control unit for actuating said illuminating element depending on an operating mode of hand-held power tool that includes said see-through region.

10. A housing device for a hand-held power tool as defined in claim 2; and further comprising a control unit for turning said illuminating element on and off periodically in at least one operating mode.

11. A housing device for a hand-held power tool as defined in claim 1, wherein said interior side face of said see-through region includes, in at least one subregion, a mask that is impermeable to at least one part of a visible optical spectrum.

12. A housing device for a hand-held power tool as defined in claim 11, wherein said mask is configured as a mask printed on said interior side face of said see-through region.

13. A housing device for a hand-held power tool as defined in claim 11, wherein said element selected from the group consisting of an information element, a signal element, and both, is configured as said light-impermeable mask.

14. A housing device for a hand-held power tool as defined in claim 13, wherein said element selected from the group consisting of an information element, a signal element, and both, is configured as an element selected from the group consisting of a corporate logo, a product label, a figure, a word and a number.

15. A housing device for a hand-held power tool as defined in claim 1, wherein said element selected from the group consisting of said information element, said signal element and both is a product label.

16. A housing device for a hand-held power tool as defined in claim 1, wherein said see-through region is configured as an elastic see-through region.

17. A housing device for a hand-held power tool as defined in claim 1; and further comprising at least one switch element being covered by said see-through region for switching an operating mode of a hand-held power tool that includes said see-through region.

18. A housing device for a hand-held power tool is defined in claim 17, wherein said switch element is configured as a flat foil switch.

19. A housing device for a hand-held power tool as defined in claim 1, wherein said see-through region is configured as a lettering motif.

20. A hand-held power tool, comprising a housing which is provided to receive an electric motor of the power tool;

at least one see-through region composed of a transparent plastic, wherein said at least one see-through region is distinct from said housing and fastened to said housing and forms an exterior side face oriented to an exterior of the housing device and an interior side face opposite to the exterior side face and oriented to an interior of the housing device; and an element selected from the group consisting of an information element, a signal element, and both, which is arranged on the interior side face of the see-through region, wherein said element selected from the group consisting of an information element, a signal element, and both, is provided with at least a first and a second symbol and a first and a second illuminating element which are distinct from said element selected from the group consisting of an information element, a signal element and both, and which are covered by said see-through region and said element selected from the group consisting of an information element, a signal element, and both, and wherein the first symbol is illuminated by the first illuminating element in a first operating mode of the hand-held power tool and the second symbol is illuminated by the second illuminating element in a second operating mode of the hand-held power tool.

21. A housing device for a hand-held power tool as defined in claim 1, wherein said element selected from the group consisting of an information element, a signal element, and both, is distinct from said see-through region.

* * * * *